United States Patent [19]

Taylor

[11] 3,993,244

[45] Nov. 23, 1976

[54] HEATING SYSTEM

[76] Inventor: Don A. Taylor, Box 4, Wadsworth, Ohio 44281

[22] Filed: Nov. 19, 1975

[21] Appl. No.: 633,482

[52] U.S. Cl. ..... 237/53; 126/110 R; 165/105; 219/341; 219/365

[51] Int. Cl.[2] ..... F24D 5/02

[58] Field of Search..... 237/50, 53; 126/110 R, 126/110 B; 165/105; 219/341, 365

[56] References Cited

UNITED STATES PATENTS

| | | | |
|---|---|---|---|
| 837,499 | 12/1906 | Perkins et al. | 165/105 |
| 2,028,260 | 1/1936 | Vernet | 165/105 X |
| 2,244,831 | 6/1941 | Drichta et al. | 165/105 X |
| 2,427,476 | 9/1947 | Schick | 219/341 X |
| 3,293,409 | 12/1966 | Snelling | 219/341 X |
| 3,834,171 | 9/1974 | Johansson | 165/105 X |
| 3,884,292 | 5/1975 | Pessolano et al. | 165/105 X |

*Primary Examiner*—William E. Wayner
*Assistant Examiner*—William E. Tapolcai, Jr.
*Attorney, Agent, or Firm*—Reese Taylor

[57] ABSTRACT

An improved heating system is disclosed including a heat-generating means and plenum, a conventional ducting system interconnecting the heat-generating means to one or more air discharge registers, particularly characterized in the utilization of a heat exchanger adjacent the heat-generating source and a heat exchanger adjacent the air discharge register, with said heat exchangers being interconnected by a heat-conducting tube carrying a quantity of thermally conductive liquid so as to utilize the improved conductivity of the liquid to minimize heat loss between the heat-generating source to the register. The invention discloses utilization of the heat-conducting tube either externally or internally of a conventional ducting system. Further, the tube is disclosed in a modification as being comprised of a plurality of segments interconnected by a slip-joint or sleeve which controls the transfer of heat between adjacent segments of the tubing. Another form of the invention is also disclosed wherein the first heat exchanger is in the heat-generating source, the conventional ducting is disposed with, and the register is connected directly to the heat-generating source by the heat-conducting tube. In this form of the invention blower means are provided adjacent the air discharge outlet.

3 Claims, 10 Drawing Figures

HEATING SYSTEM

BACKGROUND OF THE INVENTION

This invention, in general, relates to an improved heating system capable of being utilized either as a separate system or as an adaptation to an existing system and also capable of being used with any conventional heat-generating means, such as oil, gas, electric, heat pump, solar, or any other known heating device.

DESCRIPTION OF THE PRIOR ART

The most common present heating apparatus and system for homes, factories, etc., includes a furnace or heat-generating source interconnected to the air discharge registers in the various rooms by hollow ducts of thin-gauge sheet metal. The ducting is normally connected in runs into the common furnace distribution component known as a plenum. All of these methods require the distribution of heated air from the heat-generating source to the various rooms of the building, and the movement of the heated air is generated either by gravity or by a forced air blower system. It should be noted that while the above description of the prior art and the following description of the present invention refer primarily to heating, the principle disclosed herein would be equally applicable to cooling.

With regard to the aforementioned and described conventional heating system, the primary disadvantage is that the method is dependent entirely upon the conductive capabilities of the air, which has a very poor heat conductive rate and is a poor carrier of heat. Accordingly, current systems suffer approximately a twenty percent drop in temperature from the heat-generating source or furnace to the register outlet. For example, with an electric heating element which might have a temperature of 700° F at the heat-generating source, there is a temperature of about 180° F of the ambient heated air at the plenum. The air forced or gravity conveyed through the ductwork loses temperature in the amount of 40° to 50° F until it reaches the register outlet where its temperature will be in the neighborhood of 120° to 140°. This results in an average loss of as much as 20,000 BTU's between the furnace and the register.

It is accordingly the principal object of this invention to overcome this disadvantage in conventional systems and to provide a more efficient means for conveying the heat from the heat-generating source to the register outlet. In this fashion energy usage is intended to be severely reduced, and the entire system is intended to be more efficient.

SUMMARY OF THE INVENTION

It has been discovered that the above-noted disadvantages in conventional systems, due to the poor conductivity of the forced air being utilized, can be overcome by providing a heat exchanger adjacent the heat-generating source and a second heat exchanger adjacent the register outlet. It has been found that if these heat exchangers are interconnected by a heat-generating tube which is filled with a liquid having a high thermal conductivity coefficient working by capillary action, the heat drop between the heat-generating source and the register outlet can be minimized.

It has also been found that the tubing in question can be disposed either exteriorly of a conventional duct system or entirely interiorly thereof.

It also has been found that an entirely new system can be constructed utilizing the principle involved wherein the heat-conducting tubing is connected to a heat exchanger adjacent the heat-generating source and connected at its other end to a second heat exchanger adjacent the register. The heat-conducting tube can be comprised of a plurality of segments interconnected by slip-fit sleeves, and a blower can be disposed adjacent the register to provide the impetus for forcing the heat into the atmosphere of the room through the register outlet.

Accordingly, production of an improved heating system having the above-noted characteristics becomes the principal object of this invention, with other objects thereof becoming more apparent upon a reading of the following brief specification, considered and interpreted in view of the accompanying drawings.

OF THE DRAWINGS

BRIEF DESCRIPTION OF THE PREFERRED EMBODIMENTS

Figure 1:
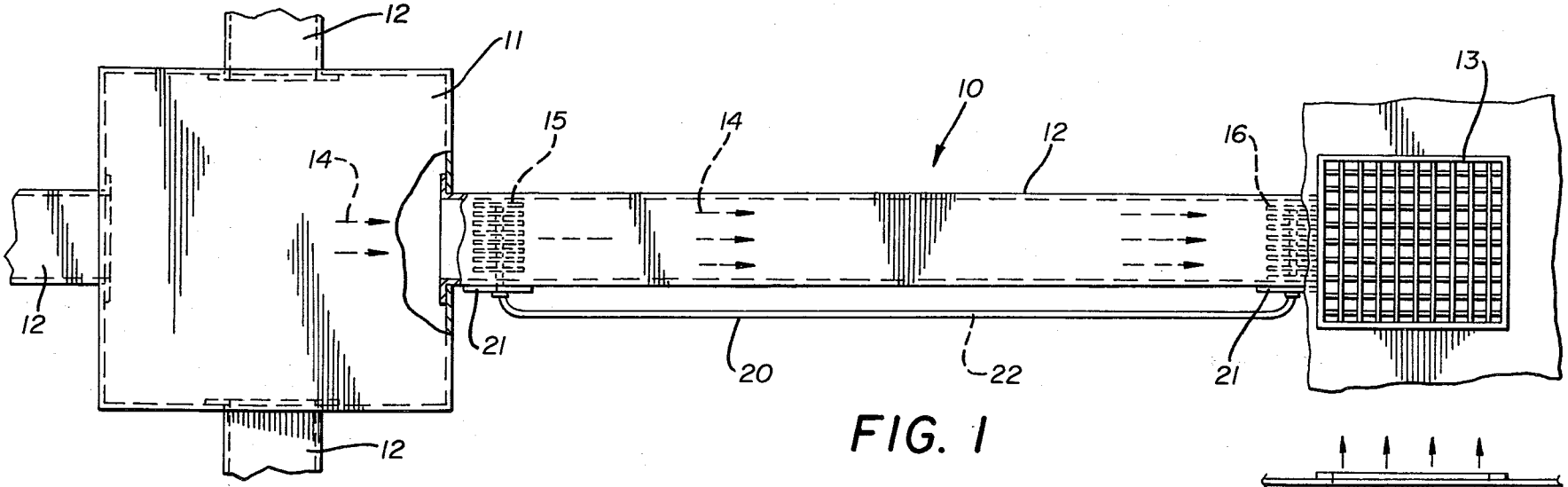
FIG. 1 is a partially schematic plan view showing a portion of a conventional heating system with the present improvement embodied therein.

Referring first to FIG. 1, it will be noted that the heating system, generally indicated by the numeral 10, includes a furnace or heat-generating source 11. This source has been illustrated schematically and is intended to represent a conventional furnace, such as a gas, oil, electric, etc., furnace. A plurality of duct outlets 12,12 are shown in FIG. 1 emanating from the furnace 11 and are, as illustrated, conventional in fashion and could be made of the sheet metal normally used in this type construction.

In this regard only one run of the duct system has been illustrated in detail, with it being understood that the remaining ducting runs would be constructed in similar fashion.

Accordingly, and referring again to FIGS. 1 and 2, it will be noted that the duct 12 is interconnected at one end to the furnace 11 and at its opposed end to an air register discharge member 13. In the conventional furnace, the heated air would be forced from the furnace 11 in the direction of the arrows 14,14, through the ductwork, and out through the register outlet 13.

In the improved system, a first heat exchanger 15 is disposed within the duct 12 adjacent the furnace or heat-generating source 11, while a second heat exchanger or heat sink 16 is disposed within the duct adjacent the register 13. A heat-conducting tube 20 is secured to the heat exchangers 15 and 16 by means of adapter plates 21,21, and this hollow tube is filled with a quantity of thermally conductive liquid material. In this regard any desired liquid could be utilized depending upon the conductive properties desired thereby.

Figure 2:
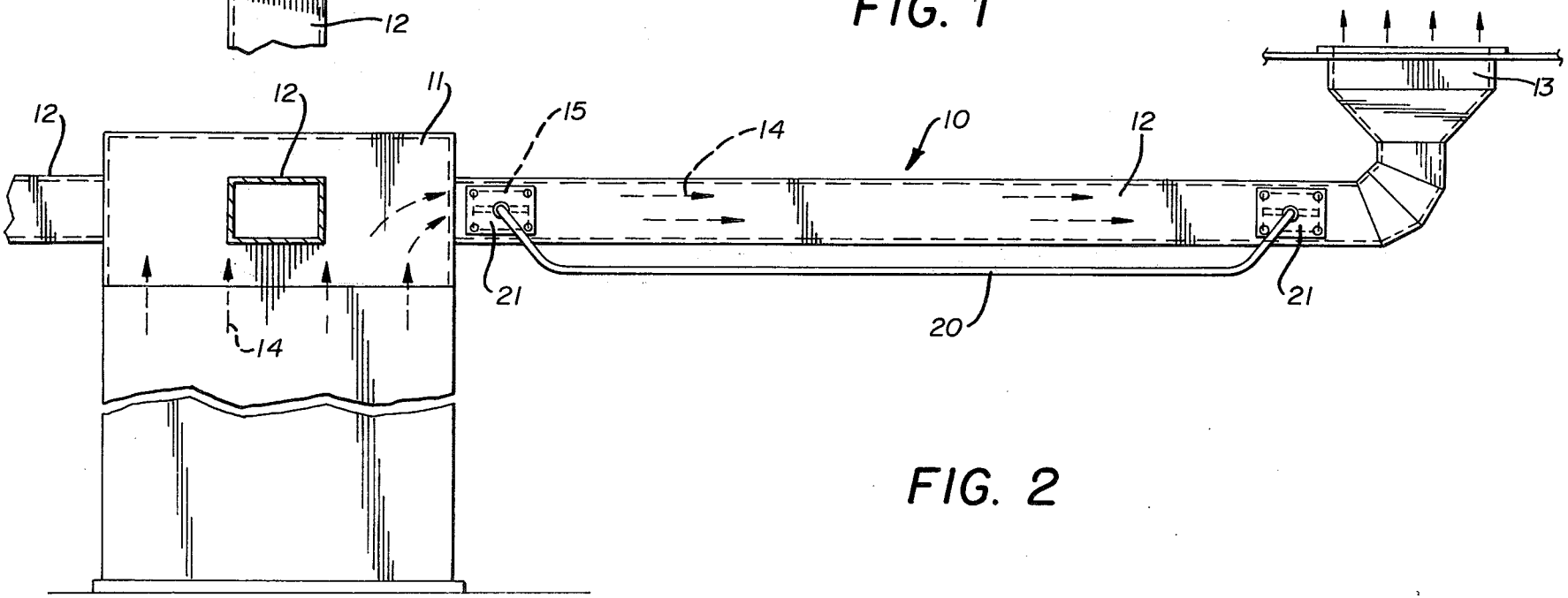
FIG. 2 is a fragmentary elevational view of the system shown in FIG. 1.
Figure 3:
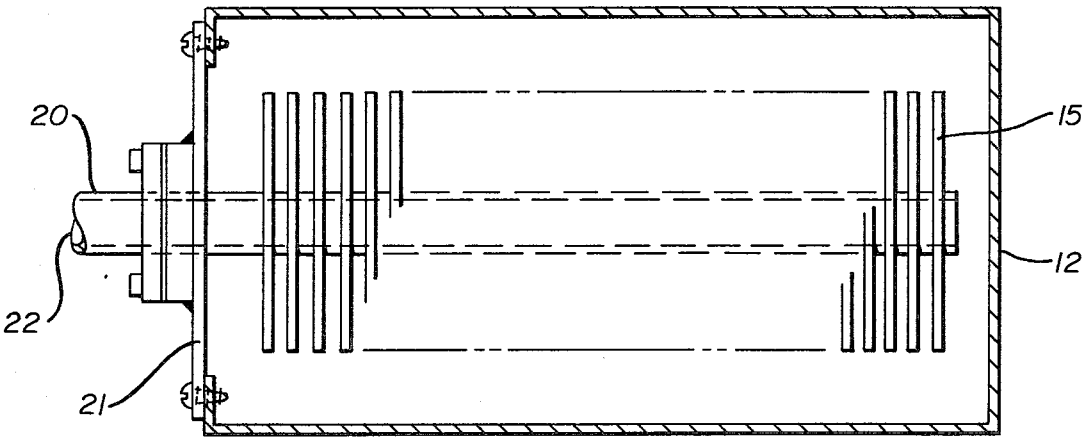
FIG. 3 is an enlarged sectional view of a cutaway taken about the middle of FIG. 2.

In use of the system shown in FIGS. 1 and 2, it will be understood that once the furnace 11 is supplied with the necessary heating materials, such as, for example, oil or gas, and activated, the air 14 will be forced out of the plenum and through the ductwork, passing through the heat exchanger or heat sink 15. This will cause the liquid 22, which is contained within the heat-conducting tube 20, to be heated, and by capillary action this heat will be transferred through the tube to the second heat exchanger 16 adjacent the register outlet 13. It has been found that the heat sink 15 will collect the heat from the furnace, which will then be transferred through the medium of the liquid along the tube 20 to the second heat exchanger 16, which will dissipate the heat into and out through the register 13.

Figure 4:
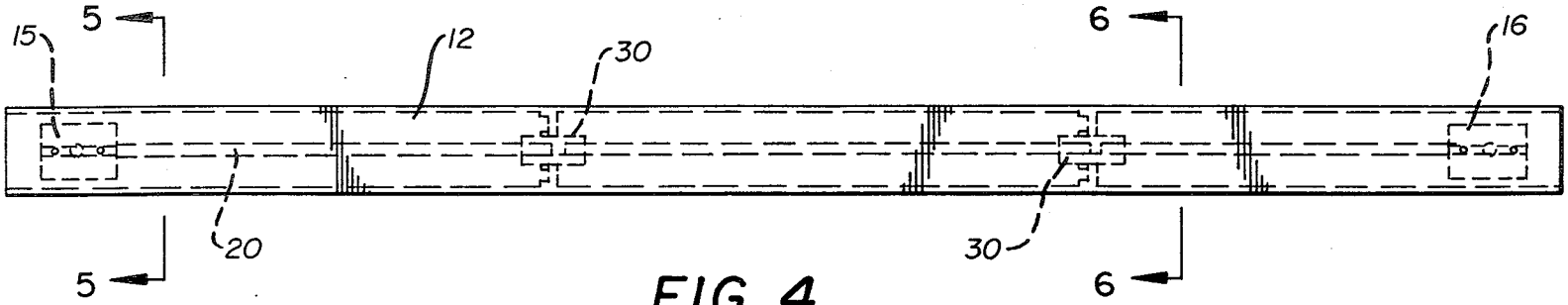
FIG. 4 is a partial plan view of another embodiment of the invention.
Figure 5:
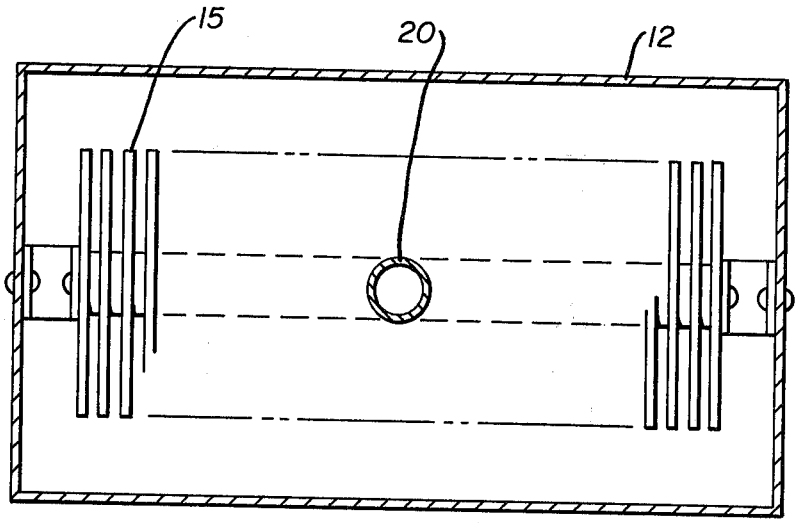
FIG. 5 is a sectional view taken along the line 5—5 of FIG. 4.

FIG. 4 shows a modified form of the invention wherein the heat-conducting tube 20 is received entirely internally of the normal duct 12. In this form of the invention, tubing is again connected to a first heat exchanger 15 and a second heat exchanger 16, one being disposed adjacent the furnace and the other adjacent the register outlet.

In this form of the invention, the tube 20 is illustrated as comprising a plurality of segments arranged in series and being interconnected by slip-joints 30. These joints are more clearly shown in FIGS. 6 and 7. In this regard the segments of the tube 20, illustrated in FIG. 7 as 20*a* and 20*b*, are interconnected by the slip-joint 30 which is constructed of a highly conductive material such as copper. In addition to performing the mechanical function of interconnecting the ends of the adjacent segments 20*a* and 20*b*, the slip-joint 30 serves the additional purpose of serving as an economical heat control means by varying the thermal conductive area of contact. In this regard it will be noted that the sleeve is not centered, and in reality the temperature is being stepped down from the source of the heat to the ultimate register outlet, or from the left to the right of FIG. 7. The amount of surface contact between the slip-joint 30 and the segments 20*a* and 20*b* will control this, and this is of particular importance when an electrical heat source is employed wherein it is necessary to severely reduce the temperature from the source to the outlet.

Figure 7:
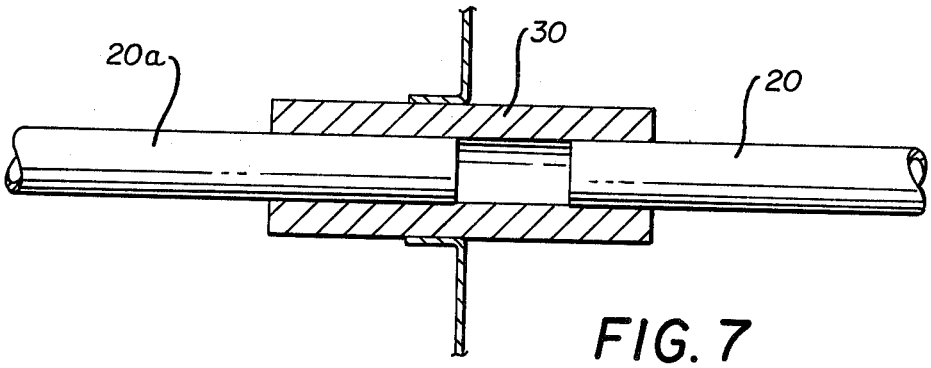
FIG. 7 is a sectional view taken along the line 7—7 of FIG. 6.
Figure 8:
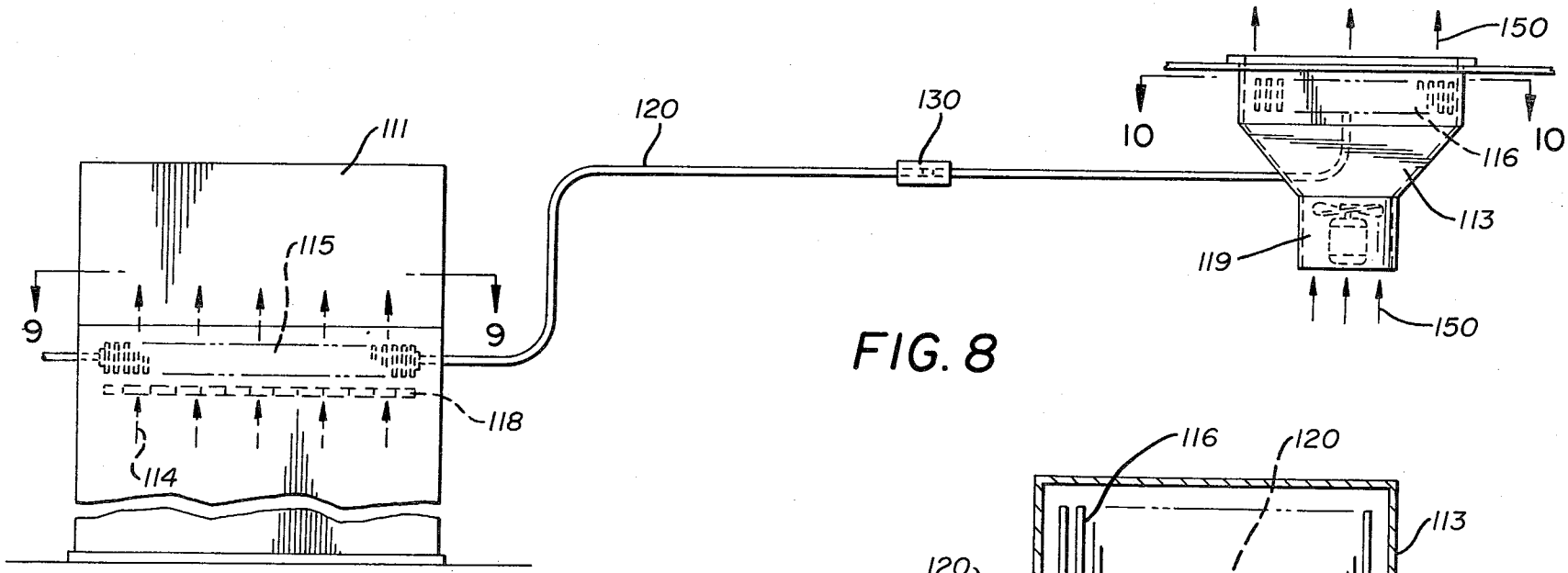
FIG. 8 is a partially schematic elevational view showing a modified form of the invention.
Figure 10:
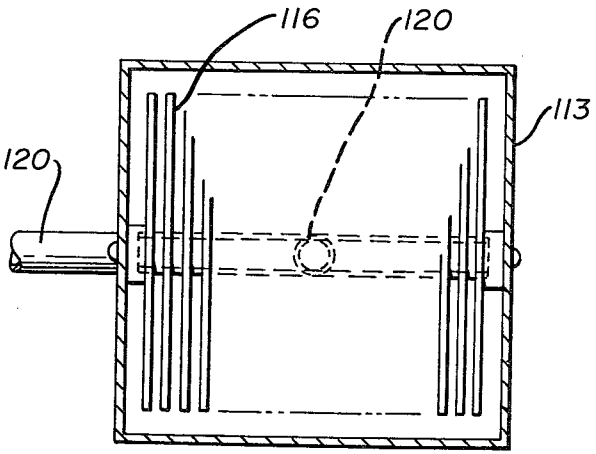
FIG. 10 is a sectional view taken along the line 10—10 of FIG. 8.
Figure 9:
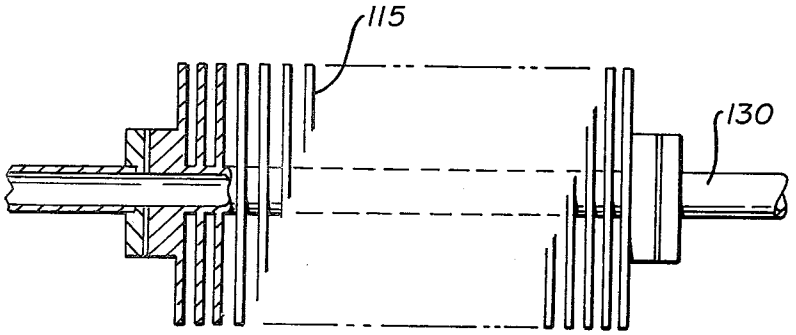
FIG. 9 is an enlarged view of the first heat exchanger shown in FIG. 8.

FIGS. 8 through 10 disclose another embodiment of the invention wherein the furnace 111, which is intended to schematically illustrate an electrical heating system, includes heating elements 118 and an air blower (not shown) wherein the heating elements 118 generate the heated air and pass it over the first heat exchanger 115 in the direction of the arrows 114. The heat thus generated is conducted to the fluid contained in the tube 120 and is ultimately conveyed to the register outlet 113, as described in connection with the form of the invention shown in FIGS. 1 through 7.

Figure 6:
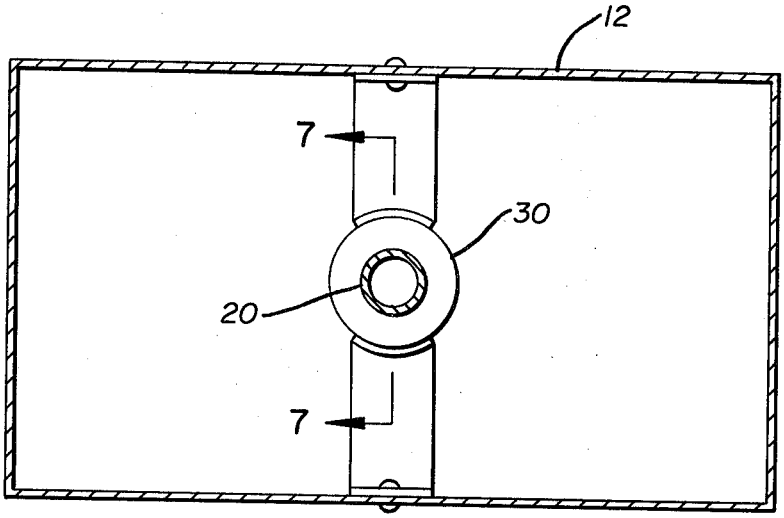
FIG. 6 is a sectional view taken along the line 6—6 of FIG. 4.

In this form of the invention, a temperature control joint 130 is employed in much the same fashion as the slip-joint 30 illustrated in FIGS. 6 and 7 and referred to above.

Adjacent the register outlet 113, a blower means 119 is employed to draw air from the atmosphere in the direction of the arrows 150 and force that air over the second heat exchanger 116 and out through the register opening in the direction of the arrows 151. The operative principles of the embodiment shown in FIGS. 8 through 10 are identical with those shown in FIGS. 1 through 7, except that the conventional ducting is completely eliminated.

It should also be noted that in the forms of the invention wherein the normal ducting is either eliminated or the heat-conducting tube is disposed externally of the normal ducting, it would be desirable to encase the heat-conducting tubing in an insulation material.

Accordingly then, while a full and complete description of the invention has been set forth in accordance with the dictates of the Patent Statutes, it should be understood that modifications can be resorted to without departing from the spirit hereof or the scope of the appended claims.

What is claimed is:

1. A heating system, comprising;

A. a heat-generating source;

B. a first heat exchanger disposed adjacent to said heat source;

C. at least one register outlet;

D. a second heat exchanger disposed adjacent to said register;

E. an air-conducting duct system interconnecting said heat source, said heat exchangers, and said register; and F. a heat-conducting tube 1. interconnecting said first and second heat exchangers,
2. disposed at least partially externally of said ducting system, and
3. carrying a quantity of thermally conductive liquid.

2. A heating system, comprising;

A. a heat-generating source;

B. at least one register outlet disposed at a position remote from said heat-generating source;

C. an air-conducting duct system interconnecting said heat-generating source and said register outlet;

D. a first heat exchanger connected to said heat-generating source in communication with said duct system;

E. a second heat exchanger disposed adjacent said register outlet within said duct system; and F. at least one heat-conducting tube 1. interconnecting said first and second heat exchangers,
2. disposed within said duct system, and
3. carrying a quantity of thermally conductive liquid.

3. The system of claim 2 wherein said heat-conducting tube comprises a plurality of sections; and coupling members telescopically interconnecting the ends of adjacent sections.

* * * * *